US010703524B2

(12) United States Patent
Gertlowski et al.

(10) Patent No.: US 10,703,524 B2
(45) Date of Patent: Jul. 7, 2020

(54) GLUE SUPPLY FOR LABELING UNIT WITH GLUE PRINTER

(71) Applicant: KRONES AG, Neutraubling (DE)

(72) Inventors: Georg Gertlowski, Schierling (DE); Stefan Poeschl, Sinzing (DE); Josef Scheck, Mintraching (DE); Florian Habersetzer, Regensburg (DE); Heinrich Bielmeier, Pilsting-Grossköllnbach (DE); Robert Scheibenpflug, Pfatter (DE); Alexander Feigl, Mintraching (DE); Andreas Kraus, Lappersdorf (DE); Dennis Baumann, Regensburg (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 16/177,940

(22) Filed: Nov. 1, 2018

(65) Prior Publication Data

US 2019/0127104 A1 May 2, 2019

(30) Foreign Application Priority Data

Nov. 2, 2017 (DE) ..... 10 2017 219 496

(51) Int. Cl.
*B65C 9/22* (2006.01)
*B05C 11/10* (2006.01)
*B65C 9/00* (2006.01)

(52) U.S. Cl.
CPC ..... *B65C 9/2286* (2013.01); *B05C 11/1047* (2013.01); *B65C 9/22* (2013.01); *B65C 2009/0071* (2013.01)

(58) Field of Classification Search
USPC ..... 156/578
See application file for complete search history.

(56) References Cited

U.S. PATENT DOCUMENTS 3,104,986 A 9/1963 Goman et al.
5,839,984 A * 11/1998 Mann ..... F16H 47/04 475/83
6,102,418 A * 8/2000 Runkel ..... B60G 17/0152 267/186
6,669,216 B1 * 12/2003 Elser ..... B06G 17/0432 280/124.106
6,928,894 B2 * 8/2005 Falcou ..... F15B 15/088 160/188
8,132,587 B2 * 3/2012 Roche ..... F17D 1/20 137/14

(Continued)

FOREIGN PATENT DOCUMENTS

DE 6603935 U 12/1969
DE 9313524 U1 10/1993

(Continued)

*Primary Examiner* — Sing P Chan
(74) *Attorney, Agent, or Firm* — McCoy Russell LLP

(57) ABSTRACT

The present disclosure provides a glue supply device for a labeling unit with a glue printer, comprising: a storage tank for glue, a supply line for supplying glue from the storage tank to the glue printer, a continuously delivering glue pump which is embodied to deliver glue from the storage tank into the supply line, and a hydropneumatic reservoir for the glue, wherein the hydro-pneumatic reservoir is arranged at the supply line upstream of the glue printer.

20 Claims, 10 Drawing Sheets

(56) References Cited

U.S. PATENT DOCUMENTS

| | | | | |
|---|---|---|---|---|
| 9,186,695 | B2 | 11/2015 | Otruba et al. | |
| 2002/0129699 | A1* | 9/2002 | Falcou | F15B 15/088 92/107 |
| 2004/0045615 | A1* | 3/2004 | Rupp | F15B 1/106 138/30 |
| 2008/0084111 | A1* | 4/2008 | Rainer | B62D 55/112 305/124 |
| 2008/0250781 | A1* | 10/2008 | Mueller | B60K 6/12 60/414 |
| 2009/0255595 | A1* | 10/2009 | Roche | F17D 1/20 137/565.15 |
| 2011/0244115 | A1 | 10/2011 | Otruba et al. | |
| 2012/0006016 | A1* | 1/2012 | Runkel | F16F 9/067 60/561 |
| 2014/0015215 | A1* | 1/2014 | Bauer | B60G 17/04 280/124.159 |
| 2014/0372007 | A1* | 12/2014 | Bauer | B60K 6/12 701/99 |
| 2018/0186494 | A1 | 7/2018 | Kronseder | |
| 2018/0186495 | A1 | 7/2018 | Kronseder | |

FOREIGN PATENT DOCUMENTS

| | | | |
|---|---|---|---|
| DE | 102011003060 | A1 | 7/2012 |
| DE | 102015212140 | A1 | 1/2017 |
| DE | 102015212198 | A1 | 1/2017 |
| WO | 2008086870 | A1 | 7/2008 |

* cited by examiner

GLUE SUPPLY FOR LABELING UNIT WITH GLUE PRINTER

CROSS REFERENCE TO RELATED APPLICATION

This present application claims priority to German Application No. 10 2017 219 496.0 entitled "GLUE SUPPLY FOR LABELING UNIT WITH GLUE PRINTER," filed on Nov. 2, 2017. The entire contents of the above-listed application are hereby incorporated by reference in their entirety for all purposes.

FIELD OF THE PRESENT DISCLOSURE

The present disclosure relates to a glue supply device for a labeling unit with a glue printer.

BACKGROUND AND SUMMARY

Labeling machines are used in industry to continuously apply labels at a high output onto continuously supplied articles, containers or packs of containers, respectively. The containers may be glass bottles, plastic bottles, in particular PET bottles, cans or can-like containers or the like, which are filled with liquid or solid food, medical or cosmetic products, hygienic products or the like. Here, the labeling machines in general comprise an often modularly designed labeling unit.

Such labeling units for labeling machines, in particular also for rotary-type labeling machines, for labeling bottles or similar containers with labels, in particular also those made of paper, using cold glue are known in prior art. Such units basically comprise at least one pallet or glue segment support that can be rotationally driven about a vertical unit axis, also referred to as pallet carousel, where a plurality of label pallets or glue segments forming at least one label receipt or label locating surface are provided. The pallets or glue segments are each embodied to be controlled to pivot about one separate swiveling axis. During labeling, the pallets or glue segments may be moved, with each circulation of the glue segment support, first past a gluing station to generate a glue application on its label locating surface, and subsequently past a label dispensing station where one label each is adopted which then adheres with its back to a label locating surface provided with the glue application and is thereby simultaneously provided with glue at its back. By means of a gripper cylinder, the labels provided with glue are each transferred to the containers moved past the labeling unit. As an alternative, the pallets, which may in particular be embodied as vacuum pallets, may be first moved past the label dispensing station to pick up a label with the image side facing the label locating surface. Subsequently, the label is taken along and guided past a gluing station with the glued side, whereby the back of the label is provided with glue. In this case, the above-mentioned gripper cylinder is omitted and the labels may be directly applied to the containers moved past the pallet carousel with their glued back.

The glue application onto the pallets or backs of the labels may be effected via a rotationally driven glue roller of which the circular cylindrical surface area is provided with a glue film by means of a glue application strip, or via a glue printer. A labeling unit having a glue printer is known, for example, from DE 10 2015 212 140. By means of individually controlled nozzles of the glue printer, the supplied glue, for example cold glue, is applied onto the pallets or labels, respectively, in a well-defined glue pattern by the ink-jet printing method.

Independent of whether a glue roller or a glue printer is employed, a continuous glue supply of the gluing station or the labeling unit is required. To this end, a glue supply device for the labeling unit is in general provided which delivers glue from a storage tank to the gluing station. In case of a glue printer, moreover a delivery at a constant glue pressure is required to guarantee a uniform glue pattern.

In the glue supply devices known from prior art, a glue container standing on the floor is generally used from which glue is pumped via hose pipes to the gluing station by means of a reciprocating pump, for example a chop check pump that is fixed to a lid of the glue container. Excessive glue may be transported back into the glue container via correspondingly disposed hose pipes. During the changing of the storage tank for the glue, however, the production is usually interrupted, and the glue pressure varies as the glue pump first must be removed to be subsequently inserted into a new, full storage tank. In the process, operators must move sometimes considerable masses because filled glue containers for cold glue often have a weight of 30 kg or more to keep the number of production interruptions as low as possible. Apart from the high weight for the operator, the contaminations of the glue occurring during the glue container replacement as well as moisture losses during the glue container replacement and during the operation of conventional labeling units with a glue roller pose a problem concerning the quality of the processed glue as its durability is often limited, as in the case of cold glue. Finally, the glue delivery by means of a reciprocating pump is inevitably subjected to pressure variations which render an efficient glue application by means of a glue printer difficult.

The object underlying the present disclosure is therefore to provide a glue supply device for a labeling unit, in particular a labeling unit with a glue printer, which permits a supply of glue to a gluing station at a constant pressure with as little interruptions as possible. In general, the object underlying the present disclosure is to increase the productivity and quality of a labeling unit. Moreover, the ergonomics of the operation of the glue supply device is to be improved.

The above-mentioned objects are achieved by a glue supply device for a labeling unit with a glue printer, comprising a storage tank for glue, in particular low-viscosity cold glue, a supply line for supplying glue from the storage tank to the glue printer, a continuously delivering glue pump embodied to deliver glue from the storage tank into the supply line, and a hydropneumatic reservoir for the glue, the hydropneumatic reservoir being disposed at the supply line upstream of the glue printer. The hydropneumatic reservoir may in particular be embodied to smooth pressure variations during the glue delivery to the glue printer.

The glue may be hot glue, UV glue, cold glue or another adhesive. In particular, viscous cold glues, such as casein glue or dextrin gum, for example, may be employed. As an alternative, dispersion glues may be used. The glue supply device according to the present disclosure may be used for low-viscosity glue, glue having a viscosity between 600 and 80000 mPas, and for casein or dispersion glue having an optimal processing temperature of 18° C. to 40° C. According to a special development, the glue supply device may be in particular employed in combination with a glue printer for low-viscosity cold glues. The viscosity of the used cold glues is here between 3 and 300 mPas, optionally within a range of 10 to 100 mPas.

Possible glue printers are described, for example, in the applicant's patent publication DE 10 2015 212 198, so that a detailed description may be omitted herein. It is only noted that the glue printer may have one or several controllable glue nozzles by means of which the glue is injected onto the glue application surface in drops or as a continuous jet under pressure. By purposefully controlling individual glue nozzles, a desired glue pattern may be created on the glue application surface. The glue printer may apply the glue pattern onto the glue application surface in particular according to the ink-jet printing method. Both an application with a continuous jet and one according to the DoD principle (Drop on Demand) are possible.

The storage tank for the glue may have a sufficient volume to permit the glue supply for a sufficiently long period. For example, the storage tank may have a glue volume of at least 20 l, optionally of at least 40 l, and of maximally 120 l. Depending on the glue pattern and the throughput of labels, the latter volume lasts for an operation of the labeling unit of about 8 to 24 hours.

The storage tank may have a level indicator. For example, a visual level indicator, in particular in the form of a viewing glass or a filling level pipe, may be provided. As an alternative or in addition, one or several filling level sensors may be provided and determine the filling level, for example via ultrasonic sound, and transmit it to the open-loop and/or closed-loop control unit described hereinafter. The filling level may be read out at a touch screen.

The supply line may be arranged such that it connects an outlet of the glue pump or a pipe piece connected with the glue pump with the glue printer. Here, the supply line may consist of a plurality of sections between which and/or at which further devices, as those described more in detail below are disposed. In particular, at least one section of the supply line may have an elastic design to permit, for example, a relative motion between the glue supply device and the glue printer or the labeling unit. In addition to the supply line, the glue supply device may also comprise a return line, in particular in case of a completely closed system, by means of which excessive glue may be conducted from the gluing station, in particular from the glue printer, back to the storage tank.

The supply line and/or the return line may be provided, in particular if hot glue is used, with a heating device which may be integrated, for example in the form of a heating wire, in the respective conduit, or which may be wound about an inner tube of the conduit. A number of alternative heating devices are conceivable, for example by means of channels through which hot water is flowing in or around the conduit. The heating device may in particular be controllable by a closed-loop control and be connected with an open-loop and/or closed-loop control unit of the glue supply device to which the glue temperature prevailing in the conduit is transmitted from a temperature sensor disposed in or at the glue conduit. The open-loop and/or closed-loop control unit may be a processor unit, in particular a stored program control (SPC). The open-loop and/or closed-loop control unit may be embodied to control the heating device as a function of the transmitted glue temperatures such that the glue is conducted through the respective conduit at an optimal processing temperature, for example between 20° C. and 40° C., optionally between 25° C. and 35° C. The desired glue temperature may here be entered by an operator, for example via a touch screen of the open-loop and/or closed-loop control unit, or be read out, as a function of the glue type used, from a storage unit of the open-loop and/or closed-loop control unit in the sense of a type management.

According to the present disclosure, the glue supply device comprises a continuously delivering glue pump by means of which glue is continuously delivered from the storage tank via the supply line to the glue printer. In contrast to the reciprocating pump mentioned above, the glue pump is a continuously delivering pump. In this manner, the pressure variations in connection with the operation of the glue pump are reduced in the supply line and at the glue printer.

For example, the glue pump may be embodied as a gear pump, in particular as an external gear pump. With a gear pump, in particular low-viscosity glue may be continuously delivered. The pump may furthermore be controllable, for example by a controllable servomotor being connected to the above-mentioned open-loop and/or closed-loop control unit. To this end, the glue supply device thus has a closed-loop or an open-loop control unit. The latter may comprise, as mentioned, a touch screen as an input and reproduction unit. Moreover, a common open-loop and/or closed-loop control unit for the glue supply device and the labeling unit may be provided.

The glue supply device may furthermore comprise a pressure gauge device, for example a pressure sensor, which are disposed directly upstream of or at the glue printer and are embodied to determine the glue pressure in the supply line upstream of the glue printer. Here, an arrangement directly upstream of the glue printer is to be understood such that the pressure sensor is arranged at a distance of less than 20 cm, optionally less than 10 cm, from the glue printer at the supply line. The determined glue pressure is transmitted from the pressure gauge device to the open-loop and/or closed-loop control unit by wires or wirelessly as a signal which in turn controls the delivery rate of the glue pump as a function of the glue pressure. Here, the delivery rate may in particular be controlled by closed-loop control such that at the glue printer, a desired glue pressure prevails that in general depends on the viscosity and which may be stored in the open-loop and/or closed-loop control unit, for example in the form of a type management, or which may be entered by an operator via the touch screen.

The open-loop and/or closed-loop control unit may consider further parameters for the control of the glue pump or the servomotor driving the glue pump, for example the above-mentioned temperature that has an influence on the viscosity of the glue. Moreover, a flow meter device may be arranged at or in the supply line and be embodied to determine the flow rate of glue through the supply line. The flow meter device may be embodied, for example, as a magnetic-inductive flow meter or as an ultrasonic flow meter. The measured flow rate may be taken into consideration by the open-loop and/or closed-loop control unit in the pump control process. Moreover, the glue type and/or the viscosity of the glue may be taken into consideration by the open-loop and/or closed-loop control unit. The open-loop and/or closed-loop control unit is thus embodied to control the glue pump as a function of the determined glue pressure, and optionally as a function of parameters such as the flow rate, temperature, viscosity and the type of glue.

According to the present disclosure, the glue supply device furthermore comprises a hydropneumatic reservoir for the glue which is arranged at the supply line upstream of the glue printer. The hydropneumatic reservoir may be embodied to smooth pressure variations during the glue delivery to the glue printer. Hydropneumatic reservoirs are well-known in prior art. In a closed container connected with a conduit via a hydraulic supply point, a gas space is separated from a liquid space by a movable and/or expandable separating element in a gas-tight manner. Gas, for example nitrogen or an inert gas, is introduced into the gas space via a filling valve in a controlled atmosphere at a desired pressure. Said pressure in particular corresponds, in the present application, to the desired glue pressure. The liquid space is filled with the liquid via a fluid connection with a conduit through which the liquid to be controlled with respect to pressure variations flows. In the present disclosure, the liquid space of the hydropneumatic reservoir is thus fluidically connected to the supply line of the glue supply device, so that the liquid space will fill with glue. The amount of gas in the gas space is here adapted such that during the operation of the pump, the desired pressure prevails. If the glue pressure differs from the desired pressure, the gas will be compressed or relieved in the gas space, depending on whether the glue pressure is above the desired pressure or below it, by moving or expanding the separating element. The compressibility of the gas thus attenuates the pressure variations of the glue in the supply line. The gas present in the gas space thus acts as a gas padding.

In other words, the hydropneumatic reservoir acts as a compensation tank that causes hydraulic decoupling between the supply line and the glue printer which stabilizes the glue pressure. To cause an effective hydraulic decoupling, the hydropneumatic reservoir may be arranged at a small distance to the glue printer. For example, a length of the supply line arranged between the junction of the hydropneumatic reservoir with the supply line and the glue printer may be less than 1 m, optionally less than 0.25 m. Due to the small distance to the glue printer, the disturbing influence of possible viscosity-dependent flow resistances is kept as low as possible.

The hydropneumatic reservoir may in particular be a membrane reservoir where the gas space is separated from the liquid space by a flexible membrane. As an alternative, the hydropneumatic reservoir may be a bladder reservoir with a flexible bladder as a separating element between the gas space and the liquid space, or a bellows reservoir with bellows as a separating element between the gas space and the liquid space. Finally, the hydropneumatic reservoir may also be embodied as a piston reservoir with a freely moving piston as a separating element between the gas space and the liquid space. The respective separating elements may in particular comprise corresponding sealing devices for separating the gas and the liquid spaces in a gastight manner. Equally, a spring or metal bellows reservoir is conceivable where a pressure spring is used instead of gas. Such reservoirs are maintenance-free.

The described glue supply device thus permits to continuously deliver glue with an approximately constant glue pressure from a storage tank to a glue printer. Due to the constant glue pressure, a well-defined glue pattern results on the one hand. On the other hand, the required amount of glue may be exactly controlled, so that both a sufficient glue application may be ensured and an excessive return of glue may be avoided. With precise control, one may thus possibly completely do without a return line for glue.

To apply glue by means of a glue printer, a working pressure of at least 15 bar, optionally of at least 30 bar, and up to 60 bar, may be required. The above described hydropneumatic reservoir thus also increases the safety of the glue supply device since it moderates undesired pressure peaks which could damage the glue nozzles of the glue printer or the supply line. To this end, the hydropneumatic reservoir may be embodied, for example, with a volume of the liquid space within a range of 0.1 l to 1 l.

Additionally, the glue supply device may comprise a safety valve at the supply line which is embodied to open an outlet when a limit pressure in the supply line is exceeded. The outlet may be connected with the exterior or, via a return line, with the storage tank. The safety valve thus acts as a pressure controller or a pressure control device. It may be arranged, for example, between the glue pump and the hydropneumatic reservoir. The safety valve may have an adjusting range for the limit pressure of 25 bar to 60 bar.

The glue supply device may furthermore comprise a retention device which is embodied to fix the glue pump to the labeling unit in a height adjustable manner. In particular, the retention device may be fixedly connected to the labeling unit or be embodied as a part thereof. By means of the retention device, the glue pump or its suction pipe may be lowered into the glue in the storage tank either manually or automatically via a linear servomotor. To change the storage tank, the glue pump may be driven out of the storage tank by means of the retention device.

This is particularly easy if the retention device comprise a telescopic rail and a cylinder with a gas pressure spring for the height adjustment of the glue pump. The gas pressure spring here facilitates the vertical movement of the glue pump. The term "vertical" is to be understood here and below with respect to a floor space of the labeling machine, for example with respect to the floor of the factory building.

According to a further development, the storage tank may be embodied to be exchangeable, in particular as a mobile module, wherein the glue supply device furthermore comprises mechanical receiving device, in particular a coupling plate, for coupling the storage tank to the labeling unit. Furthermore, the storage tank may be exchangeably arranged on a mobile module, for example a pack carriage. According to this development, the respectively employed storage tank is thus not fixedly connected, but via the receiving device releasably connected to the labeling unit. The receiving device may only serve as a positioning aid or comprise a mounting for the storage tank. The latter permits to move the storage tank along if the labeling unit must be lifted vertically, for example for attaching labels to higher containers.

To change the storage tank, the glue pump may first be driven out of the emptied storage tank by means of the height adjustable retention device manually or automatically, where the storage tank may then be easily removed manually. Subsequently, a new filled storage tank may be rolled to the labeling unit, for example by means of a pack carriage. The pack carriage can to this end have rollers and a guide rod which moreover fulfils, together with a mounting of the pack carriage for storage tanks, a lever function by means of which the full storage tanks may be received with a low expenditure of force and loaded onto the pack carriage. At the labeling unit, the new storage tank is inserted into the receiving device, for example with the aid of the lever function of the pack carriage. The pack carriage may be subsequently removed or remain at the labeling unit. In the described development, the operator thus neither has to lift the storage tank nor carry it. Thus, the storage tank may be brought into the intended position without any major expenditure of force and by means of the coupling plate. Subsequently, the glue pump is again lowered into the glue by the retention device. The change of a storage tank may thus be done within one minute only, whereby a possible interruption of the production is considerably reduced. Moreover, the described development improves the ergonomics of the device.

According to an alternative development, the storage tank may be fixedly connected to the labeling unit, for example with a housing or frame of the labeling unit. In this case, the storage tank does not have to be exchanged but only refilled. To this end, in particular the glue pump does not have to be driven out of the storage tank. The storage tank may rather have a lid which may be at least partially opened. Through the opened lid, the storage tank may be filled as required. Refilling may be effected, for example, by means of canisters, optionally in a pack size of 5 l to 10 l. Due to the small pack size, no large loads must be moved by the operator. As an alternative, the storage tank may be refilled via a barrel pump or via a central glue supply manually or automatically via a corresponding pump control. The latter may be done depending on a detected filling level of the glue in the storage tank, for which the above-mentioned filling level sensors may be provided.

The refilling of the storage tank with glue may in particular be effected already before the complete emptying of the storage tank by the operation of the labeling unit, so that an interruption of production may be avoided. Since the storage tank is directly fixed to the labeling unit, it may be embodied with a sufficient storage volume, for example within a range of 40 l to 120 l, to permit a permanent operation of the labeling unit of several hours. If one assumes, for example, a label surface of 175 $cm^2$ of which 60% are provided with glue, a glued surface of 105 $cm^2$ results. With a glue consumption of 16 g per $m^2$ of glued surface, thus approx. 170 g of glue are required for 1000 bottles. If the labeling machine has a machine output of 50,000 bottles per hour, about 8.5 kg of glue per hour are thus required. A storage volume of 120 l thus permits a permanent operation of about 14 hours.

Independent of the arrangement of the storage tank, the glue supply device may furthermore comprise an auxiliary tank, the auxiliary tank being connected with the glue pump such that during a change of the storage tank, glue is withdrawn from the auxiliary tank by means of the glue pump. This may be achieved, for example, by a suction pipe of the glue pump being connected with the auxiliary tank via a valve which may be opened during a change of the storage tank. Correspondingly, a further valve may be provided in a suction pipe by means of which the glue pump sucks glue out of the storage tank, while the further valve for changing the storage tank is closed. As an alternative, the glue pump may comprise a branched suction pipe at the branch of which a three-way valve determines whether glue is sucked out of the storage tank or the auxiliary tank.

According to a special development, the auxiliary tank may in particular surround the glue pump and have a valve element which is embodied to open the auxiliary tank when in contact with a bottom of the storage tank, and to close it otherwise. More in detail, the valve element includes a mechanical and/or magnetic device to this end which is actuated by mechanical contact of the auxiliary tank with the bottom of the storage tank such that the valve element may be moved to an opened position. In this case, glue may thus be delivered from the storage tank through the glue pump located in the auxiliary tank.

If the auxiliary tank is not in contact with the bottom of the storage tank, the valve element closes the auxiliary tank. In this case, the glue pump located in the auxiliary tank only delivers the glue located in the auxiliary tank. The volume of the auxiliary tank may be, for example, at least 0.3 l, optionally at least 1 l, to provide a sufficient amount of glue for the time required for changing the storage tank. Since the auxiliary tank surrounds the glue pump, it may in particular be connected to it mechanically, so that the auxiliary tank may be driven out of the storage tank together with the glue pump to change the storage tank.

The opening of the auxiliary tank which is closable by the valve element may in particular be located in the bottom of the auxiliary tank or in a lower region of the auxiliary tank. If the opening is located in the bottom, the glue located in the storage tank may be pumped out nearly completely. In addition to the opening which is closable by the valve element, the auxiliary tank may have one or more inlet openings for the glue. These may be in particular disposed at an upper side of the auxiliary tank, for example in a lid, to be closable by the valve or to be always open. The dimensions and the shape of the auxiliary tank and the relative position of the openings of the auxiliary tank may be selected such that the auxiliary tank is initially filled with glue from the storage tank via the inlet openings by lowering it into the filled storage tank which glue subsequently serves as a buffer during the change of the storage tank. If the auxiliary tank is driven out of the storage tank together with the glue pump for changing the storage tank, the contact with the bottom of the storage tank is released and the valve element closes the lower opening that serves as a suction opening for the glue pump in the storage tank. Then, glue is thus only delivered from the auxiliary tank, so that the storage tank may be easily changed.

According to a special development, the glue pump may be embodied to be movable relative to a bottom of the auxiliary tank. In particular, the glue pump may be designed such that in contact with the bottom of the auxiliary tank, it no longer delivers any glue from the auxiliary tank. This may be permitted, for example, by correspondingly arranging a glue inlet opening of the pump, i.e. the pump inlet, and providing a sealing ring that seals the pump inlet with respect to the interior of the auxiliary tank in contact with the bottom of the auxiliary tank.

According to a special development, the bottom of the auxiliary tank may have a bore, the bore forming, by lowering the glue pump, together with a corresponding glue inlet opening of the glue pump, a supply line for glue from the storage tank that is closable via the valve element. The bore is thus in particular arranged opposite to the glue inlet opening of the glue pump. By lowering the glue pump, the glue inlet opening is brought into contact with the upper opening of the bore thus forming a supply line for glue. Via the lower opening of the bore or via a glue channel connecting the bore with the exterior of the auxiliary tank in the bottom of the auxiliary tank, glue from the storage tank may then be sucked in. The supply line formed by the bore, the glue inlet opening and the glue channel thus connects a delivery space of the glue pump, for example the space where the gears of a gear pump are arranged, with the exterior of the auxiliary tank or the storage volume of the storage tank. To seal the formed supply line with respect to the interior of the auxiliary tank, the above-mentioned sealing ring may be provided at the bottom of the glue pump.

By providing the described auxiliary tank, the period during which the storage tank is being changed may be easily bridged. The auxiliary tank thus ensures a glue supply by the glue supply device according to the present disclosure without any interruptions. The prevention of any interruption of the glue supply moreover permits a constant glue pressure at the glue printer since the starting of any glue pump after an interruption of production always involves a relatively slow increase of the glue pressure to the working pressure. In combination with the attenuation of delivery-dependent pressure variations by the hydropneumatic reservoir, with the described glue supply device, a constant glue pressure may thus be provided without any interruptions, which in particular renders the use of a glue printer economically interesting.

The present disclosure also provides a labeling unit for applying labels onto containers, comprising a glue supply device according to the above-described developments. Moreover, the labeling unit according to the present disclosure comprises a pallet carousel with a plurality of pallets driven to circulate about an axis of rotation and a glue printer arranged in the periphery of the pallet carousel and having a plurality of glue nozzles controllable individually or in groups. Pallet carousels are well-known in prior art so that a detailed description is omitted here. It should be only noted that the pallets may be embodied as vacuum pallets connected with a vacuum device for generating a vacuum at the pallet. In this case, the pallets may be guided, upstream of the glue printer, past a label provision unit, for example a label box, from which they receive the labels with the image side facing the label locating surface. The backs of the labels are subsequently provided with a desired glue pattern by means of the glue printer. As an alternative, glue application surfaces of the pallets may be provided with glue by the glue printer. In this case, the label provision unit is disposed downstream of the glue printer, and the labels are here transferred to the glued pallets with their backs. Subsequently, the labels may be picked up by a gripper cylinder of the labeling unit and transferred to the containers. A plurality of variations of the labeling unit is conceivable and combinable with the glue supply devices according to the present disclosure. For example, instead of a label box, a label cutting device for cutting a continuously supplied label tape may be provided. The glue printer may be operated, as already described above, according to the ink-jet printing method and be provided with a plurality of glue nozzles controllable individually or in groups. The control may be effected via the above described open-loop and/or closed-loop control unit.

The above-mentioned objects are also achieved by the use of the above-described glue supply device where the storage tank is designed to be exchangeable, in particular as a mobile module, wherein, for changing the storage tank, the glue pump is driven out of the storage tank by means of the above-described retention device, and wherein a filled storage tank is approached to the glue supply device by means of a pack carriage.

If the remaining glue stock in the storage tank is insufficient, the glue pump may be driven out of the storage tank without major expenditure of force to such an extent that the empty storage tank may be easily removed manually, as described more in detail above. Subsequently, a filled storage tank is driven towards the glue supply device and there docked, for example, to a coupling plate. The glue pump is subsequently driven into the filled storage tank by means of the retention device, wherein in particular, as described more in detail hereinafter, the auxiliary tank may be brought into contact with the bottom of the storage tank. Thereby, a valve element of the auxiliary tank, via which glue may be sucked from the storage tank, is opened. Said valve element is automatically closed when the glue pump is driven out of the storage tank, for example as described below, by correspondingly arranged magnets or a readjusting spring, so that during the changing of the storage tank, glue may be pumped from the auxiliary tank. The latter thus serves as a glue buffer for the changing process. The use according to the present disclosure thus permits a supply with glue without any interruptions.

The above-mentioned objects are finally also achieved by the use of a glue supply device whose storage tank is permanently fixed to the labeling unit, with a glue having a viscosity within a range of 3 to 300 mPas, optionally within a range of 10 to 100 mPas, wherein the storage tank is refilled through the open lid by means of canisters. When a low-viscosity glue is used, i.e. with a viscosity within the indicated ranges, the storage tank may also be comfortably filled via a lid that can be opened. This may be done by the operator by means of a canister, wherein the pack size for the canister may be within a range of 5 l to 10 l. In this manner, the operator does not have to move large loads. The refilling of the storage tank may be effected during operation, so that the storage tank may be effectively prevented from running empty. In this use of the glue supply device, too, a glue supply free from interruptions may be achieved.

DESCRIPTION OF THE FIGURES

Further features and exemplary embodiments as well as advantages of the present disclosure will be illustrated more in detail hereinafter with reference to the drawings. It will be understood that the embodiments do not exhaust the field of the present disclosure. It will be furthermore understood that some or all features described below may also be combined with each other in a different way.

DETAILED DESCRIPTION

Figure 1:
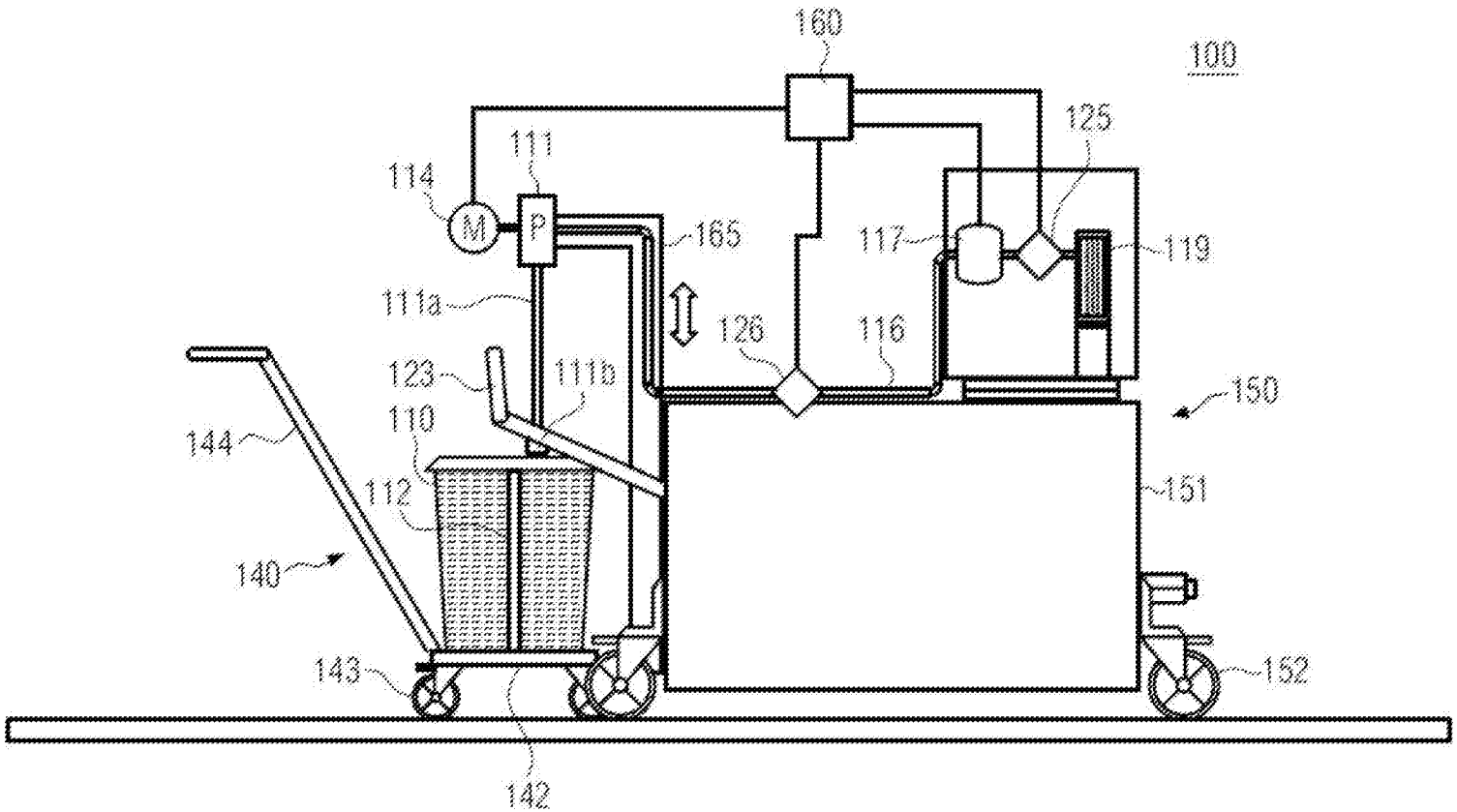
FIG. 1 schematically shows a side view of a glue supply device for a labeling unit with a changeable storage tank for glue according to the present disclosure.

Below, the same or equal elements are designated with the same reference numerals. A repeated description of these elements is omitted for clarity reasons. Moreover, it will be understood that in the following embodiments, some or all elements may be replaced or combined by or with equal elements described in connection with other embodiments.

FIG. 1 schematically shows a side view of a glue supply device for a labeling unit with a changeable storage tank for glue according to the present disclosure. The figure shows the glue supply device 100 in combination with a modularly designed labeling unit 150. In the represented, not limited development, the glue supply device is fixedly connected to the labeling unit 150 and forms a module movably mounted on rollers 152 which may be placed, for example, against a container table (not represented) for the container transport. The labeling unit 150 is only shown as a frame 151 that is mounted on rollers 152 in FIG. 1, but it may in particular include the units and devices described in connection with FIG. 9. The labeling unit 150 moreover has a glue application unit in the form of a glue printer 119. Moreover, the labeling unit 150 may comprise a guide handle 123 for shifting the unit.

The glue printer 119 is provided with glue from a changeable storage tank 110 by the glue supply device. In the shown development, the storage tank 110 is standing on a mobile pack carriage 140. The pack carriage 140 has, apart from an erection or receiving surface 142 for storage tanks, also a guide rod 144 by means of which the pack carriage 140 mounted on rollers 143 may be driven towards the labeling unit 150 without major efforts. Here, the guide rod 144 may be connected with a receiving device 142 such that a storage tank 110 may be easily picked up and lifted by lever action. The storage tank 110 taken along may be placed or docked on or at a corresponding tie point, for example a coupling plate (not represented), of the labeling unit 150. Here, the storage tank 110 may remain, for the sake of simplicity, on the pack carriage 140, as is shown. This permits a particularly effortless and easy change of the storage tank 110.

In the shown development, the storage tank 110 has a level indicator 112 in the form of a viewing glass where the filling level of glue in the storage tank may be seen. The glue is pumped from the storage tank 110 into the supply line 116 via the suction opening 111*b* of a suction pipe 111*a* by means of a glue pump 111 which is driven by a motor 114, in particular a controllable servomotor. As an alternative, as will be described more in detail hereinafter, a gear pump at the lower end of a rising pipe may be lowered into the storage tank and driven by a controllable motor. The motor 114 is connected with the open-loop or closed-loop control unit 160 of the shown glue supply device 100 which receives as input signals, for example, the flow rate of glue in the supply line 116 determined by a flow meter device 126, and the glue pressure determined by a pressure sensor 125 directly disposed at the glue printer 119. Depending on these input signals and optional other input parameters, such as the glue temperature and/or the viscosity of the glue, the open-loop and/or closed-loop control unit 160 controls the pump performance of the glue pump 111 which may continuously deliver glue to the glue printer 119 with a constant glue pressure.

To moderate pressure variations at the glue printer 119, a hydropneumatic reservoir 117, for example in the form of a membrane reservoir, is arranged at the inlet to the glue printer and in fluid connection with the supply line 116. As is shown, the hydropneumatic reservoir may be arranged in particular close to the glue printer 119. By means of the hydropneumatic reservoir, the glue printer 119 may be hydraulically decoupled from the glue pump 111, so that pressure variations generated by the glue pump are not or only partially transferred to the glue printer. In this manner, a uniform glue pattern may be guaranteed. The hydropneumatic reservoir 117 may also be connected with the open-loop and/or closed-loop control unit 160. For example, the hydropneumatic reservoir 117 may include a control valve (not represented) which is connected with a source for a filling gas, for example nitrogen, and limits the maximum pressure in the gas space of the hydropneumatic reservoir. As a function of the desired glue pressure, the open-loop and/or closed-loop control unit 160 may control the control valve such that the required amount of gas is always present in the gas space of the hydropneumatic reservoir.

In the development shown in FIG. 1, both the supply line 116 and the sensors 125 and 126, the hydropneumatic reservoir 117 and the open-loop and/or closed-loop control unit 160 are fixedly connected with the labeling unit 150. As an alternative, the mentioned elements may also be embodied as part of a modularly designed glue supply device which may be coupled to a separately formed labeling unit. In the shown development, moreover a height adjustable retention device 165 for the glue pump 111 and the motor 114 which are fixedly connected with the labeling unit 150 are provided. By means of the retention device 165, the suction opening 111*b* may be immerged into the glue present in the storage tank 110 and removed from it again after the storage tank has been emptied. The empty storage tank may then be easily replaced by the operator.

Figure 2:
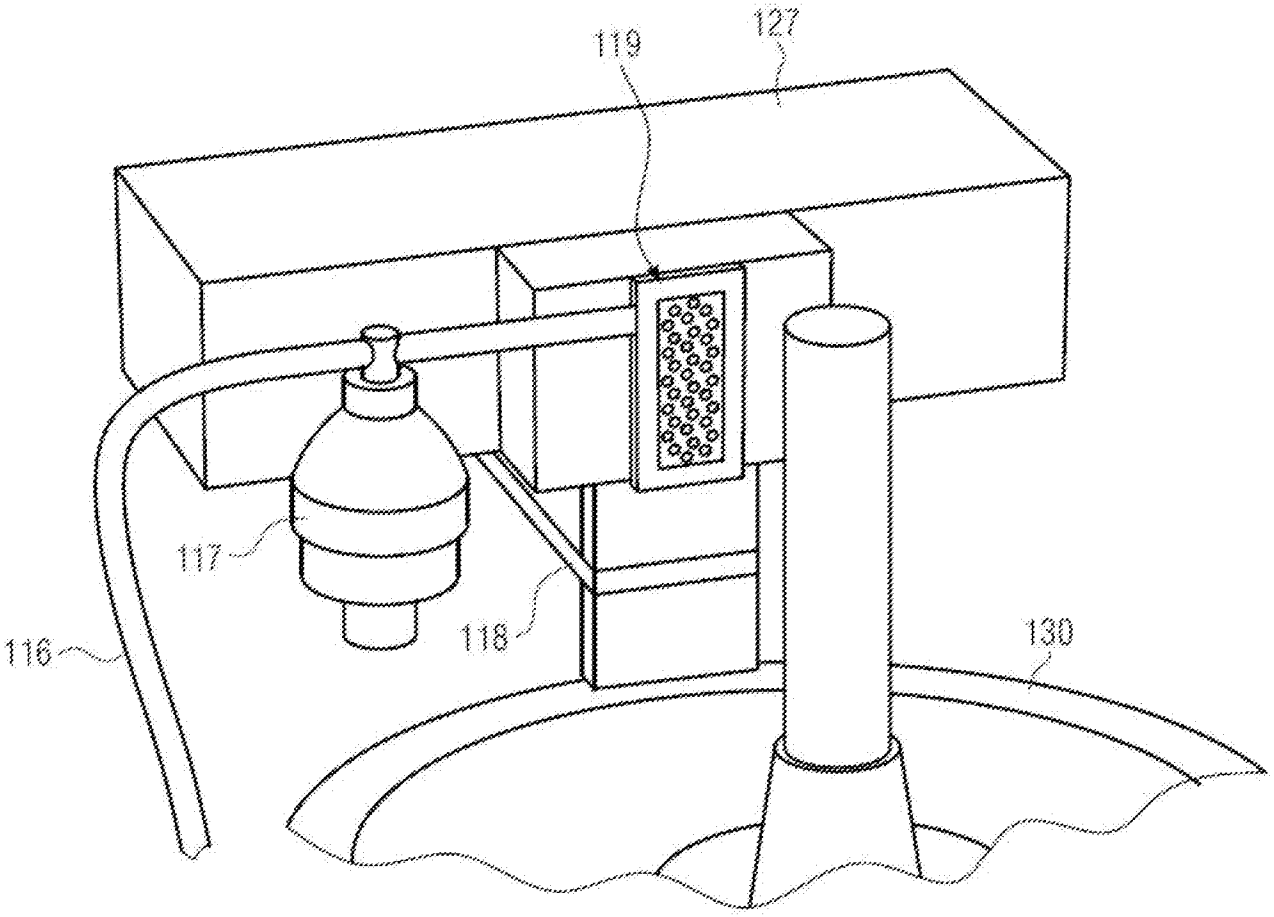
FIG. 2 shows the arrangement of a hydropneumatic reservoir in the inlet to the glue printer according to the present disclosure.

FIG. 2 shows the arrangement of a hydropneumatic reservoir in the inlet to the glue printer according to the present disclosure. The shown development shows the lower part of a pallet carousel 130 where a plurality of pivoted pallets, which are not represented for a better overview, are circulated. During their circulation, the pallets pass the glue printer 119 provided with a plurality of glue nozzles at a small distance, the glue printer 119 applying the desired glue pattern either onto a glue application surface of the pallets or directly onto a back of labels that are taken along by the pallets. The glue nozzles may be individually controlled by a control unit 127 of the glue printer 119.

Via a supply line in the form of an elastic tube 116, the glue printer 119 is provided with glue. To compensate pressure variations, according to the present disclosure, a hydropneumatic reservoir 117 is disposed at the supply line 116 in the direct vicinity of the glue printer. The reservoir may have, as described, a volume of the liquid space within a range of 0.1 l to 1 l. In the shown development, the glue printer 119 is connected with the pallet carousel and/or the labeling unit 150 via a mounting 118.

Figure 3B:
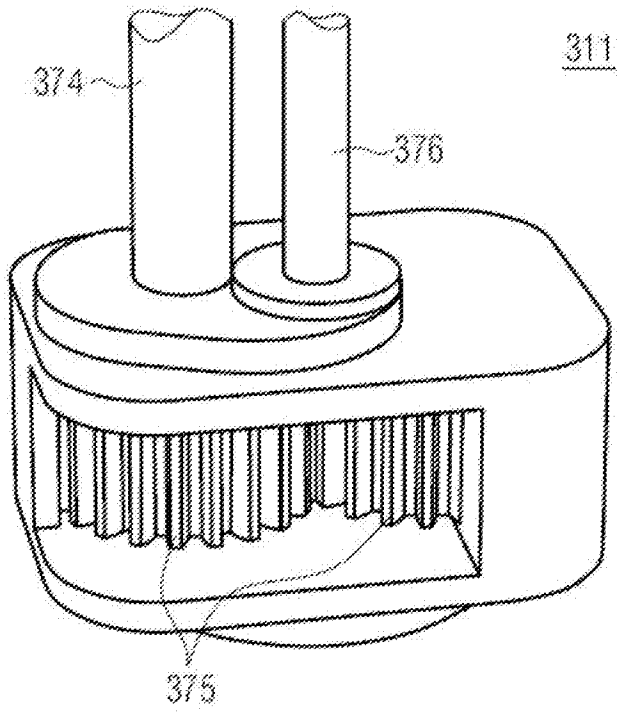
FIGS. 3A and 3B show a glue pump according to the present disclosure.
Figure 3A:
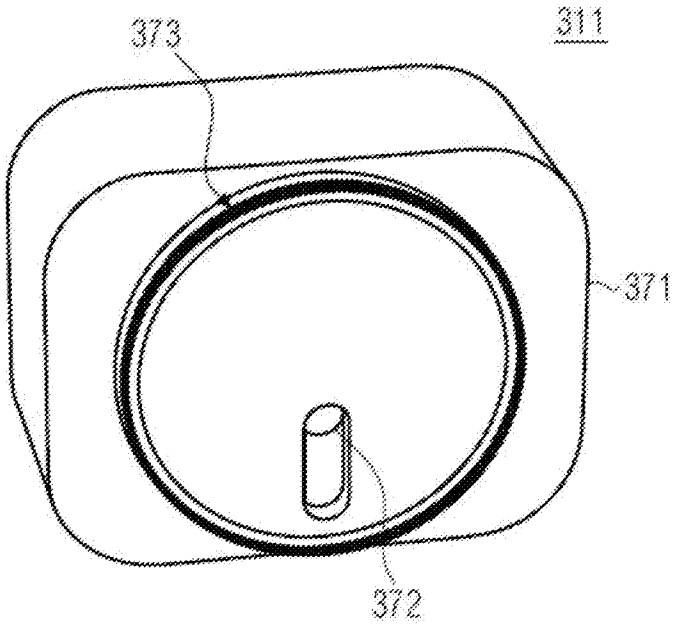

FIGS. 3A and 3B show a glue pump 311 according to the present disclosure. The shown glue pump 311 is an external gear pump where the gears 375 are arranged in a housing 371 enclosing a delivery space of the pump. The housing 371 has, at its bottom side, a glue inlet opening 372 via which the glue can enter the delivery space of the pump. Furthermore, in the shown development, a sealing ring 373 is arranged at the bottom side of the housing 371 by which the glue inlet opening 372 may be sealed with respect to the interior of an auxiliary tank surrounding the housing 371 as will be described below more in detail. By a shaft arranged in a shaft housing 374 and driven by a motor (not represented), the gears 375 are driven such that the glue that has entered the delivery space of the glue pump 311 via the glue inlet opening 372 is transported into the rising pipe 376. The rising pipe 376 may in particular be connected with the above-mentioned supply line. The use of a gear pump 311 permits a continuous glue delivery with very low pressure variations.

Figure 4:
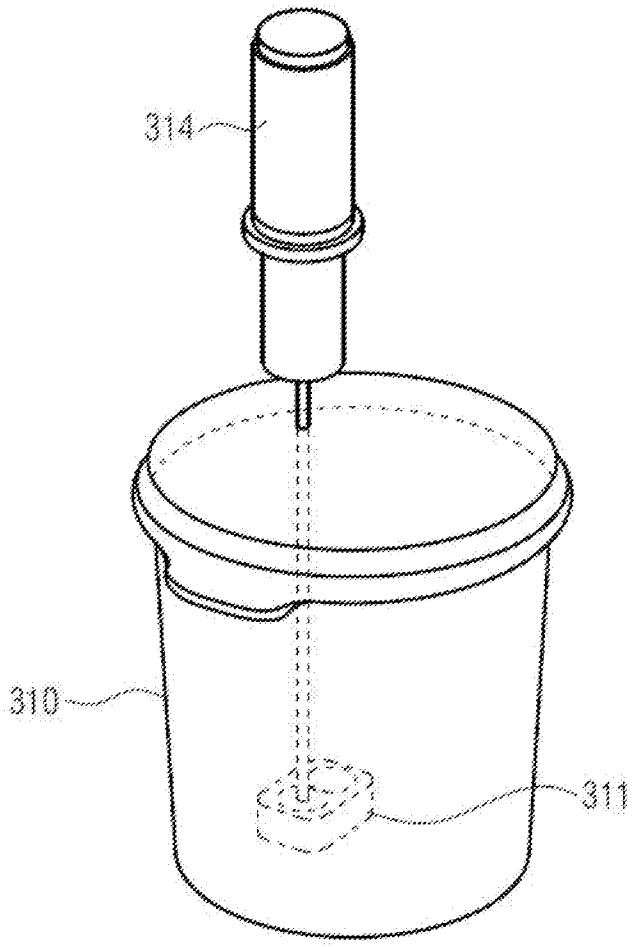
FIG. 4 shows the glue pump lowered into the storage tank.

FIG. 4 shows the glue pump 311 lowered into the storage tank 310. The storage tank 310 is embodied, in the shown development, as a bucket with handles at the upper edge. The only schematically shown gears of the glue pump 311 are driven by the above-mentioned shaft by a controllable servomotor 314 arranged outside the storage tank 310. By vertically shifting the motor 314 and the glue pump 311 together, the glue pump 311 may be driven out of the storage tank 310 so that the latter may be replaced.

Figure 5:
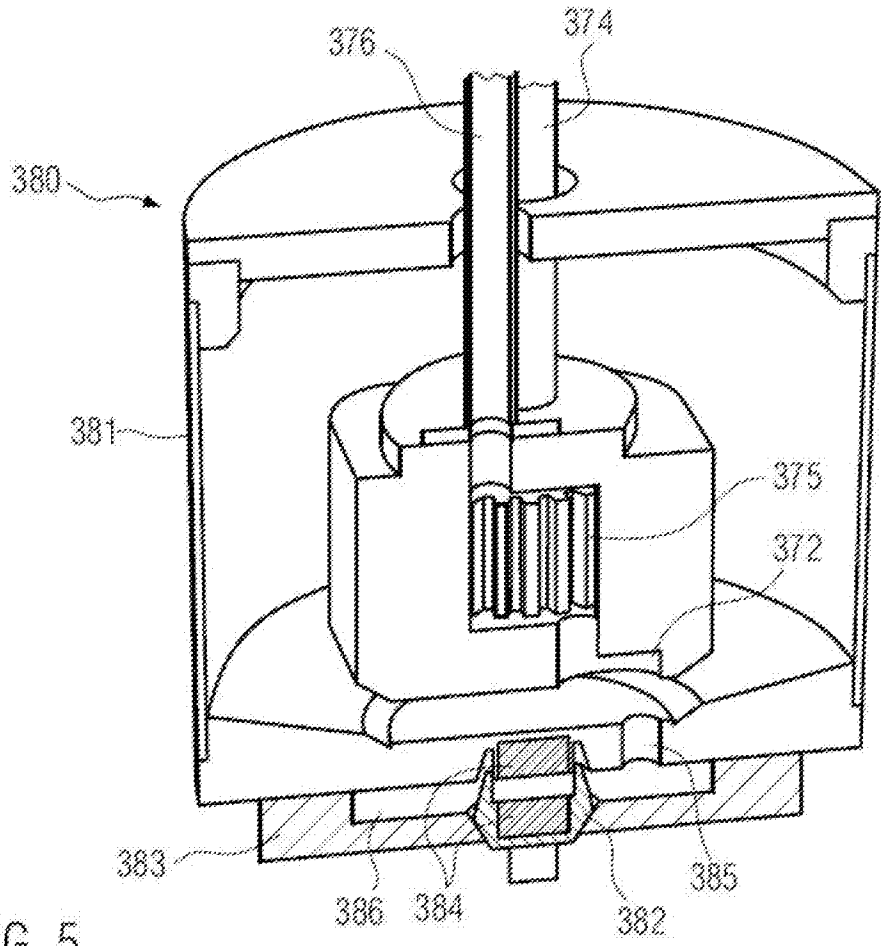
FIG. 5 shows the auxiliary tank surrounding the glue pump in a floating position during the change of the storage tank.

FIG. 5 shows the auxiliary tank 380 surrounding the glue pump 311 in a floating position during the change of the storage tank 310. According to the shown development, the housing surrounding the gears 375 is embodied to be movable together with the shaft housing 374 and the rising pipe 376 relative to the auxiliary tank 380. In the shown floating position, where the auxiliary tank is not standing on the bottom of the storage tank 310, the glue pump 311 is positioned, for example via spacers arranged at the shaft housing 374 which can be brought into contact with an upper part, for example a lid, of the auxiliary tank 380, relatively within the interior of the auxiliary tank 380 such that a major part of the glue located in the auxiliary tank may be sucked off via the glue inlet opening 372 of the glue pump. In other words, the glue pump, and in particular the spacer, is designed such that the glue inlet opening 372 is located, in the floating position of the auxiliary tank, in the lower third, optionally in the lower fourth, of the interior volume of the auxiliary tank. In this manner, the auxiliary tank may be nearly completely pumped empty in the floating position, which is after all in particular given when the storage tank is being replaced. The interior volume of the auxiliary tank 380 thus serves as a buffer storage for glue during the changing process for the storage tank. To this end, the interior volume may be in particular at least 0.3 l, optionally at least 1 l, so that an operator has sufficient time to change the storage tank and lower the glue pump again into the storage tank.

The completely or partially emptied auxiliary tank 380 may be filled with glue again when it is lowered into the new storage tank. To this end, the auxiliary tank 380 may have, in the upper region of the tank wall 381 or in a lid region of the auxiliary tank, one or several inlet openings through which glue may enter the auxiliary tank. In the shown development, this is elegantly achieved by the bores in the lid of the auxiliary tank 380 for the shaft housing 374 and the rising pipe 376 being embodied to be wider than the cross-section of the respective pipe so that glue may flow in through these openings. The constant relative motion of the shaft housing and the rising pipe moreover take care that the openings are not clogged with cured glue. The dimensions of the auxiliary tank 380, in particular its overall height and/or the arrangement of the inlet openings, may be selected with respect to the dimensions and the common fill height of the completely filled storage tank such that the auxiliary tank is, after it has been lowered onto the bottom of the storage tank, reliably filled with glue via the inlet openings.

According to the shown development, the auxiliary tank 380 has a bore 385 in its tank bottom 383 which connects the interior of the auxiliary tank via a glue channel 386, here in an annular design, in the bottom of the auxiliary tank with the exterior of the auxiliary tank, i.e. the storage volume of the storage tank 310. A movable valve element 382 is arranged in the glue channel 386 and is designed such that it closes the glue channel and thus the connection to the exterior of the auxiliary tank in the floating state of the auxiliary tank 380.

The special valve element 382 represented here has a plug-like basic shape and moreover includes a permanent magnet 384 which interacts in a repelling manner with a permanent magnet 384 with the same polarization which is correspondingly arranged on the opposite side of the glue channel 386. At its lower end, the plug-like valve element 382 has an extension protruding beyond the bottom plate 383 of the auxiliary tank 380 which may be brought into mechanical contact with the bottom of the storage tank. The repelling interaction of the magnets 384 pushes the valve element 382 into a closed position as long as the auxiliary tank is freely floating and in particular the lower extension of the valve element is not in mechanical contact with the bottom of the storage tank. In the floating position, the auxiliary tank 380 is thus closed towards the bottom by the valve element 382 so that the glue pump 311 may pump off the glue located in the auxiliary tank via the glue inlet opening 372. To this end, the arrangement of the glue pump in the interior of the auxiliary tank 380 in the floating position is in particular selected such that a sufficient distance, e. g. at least 1 cm, from the bottom of the auxiliary tank remains so that the glue located in the auxiliary tank may enter the delivery space of the glue pump via the glue inlet opening 372. It will be appreciated that other developments of the valve element 382 are also possible. In particular, instead of the magnets 384, a readjusting spring may be provided which pushes the valve element into the closed position. The arrangement and embodiment of the bore 385 and the glue channel 386, too, may be varied as long as the bore 385 is opposite the lower opening of the glue inlet opening 372 in the vertical direction, as will be stated more in detail below. In a special development, one may completely eliminate the glue channel 386 if the valve element 382 is directly arranged in the bore 385.

Figure 6:
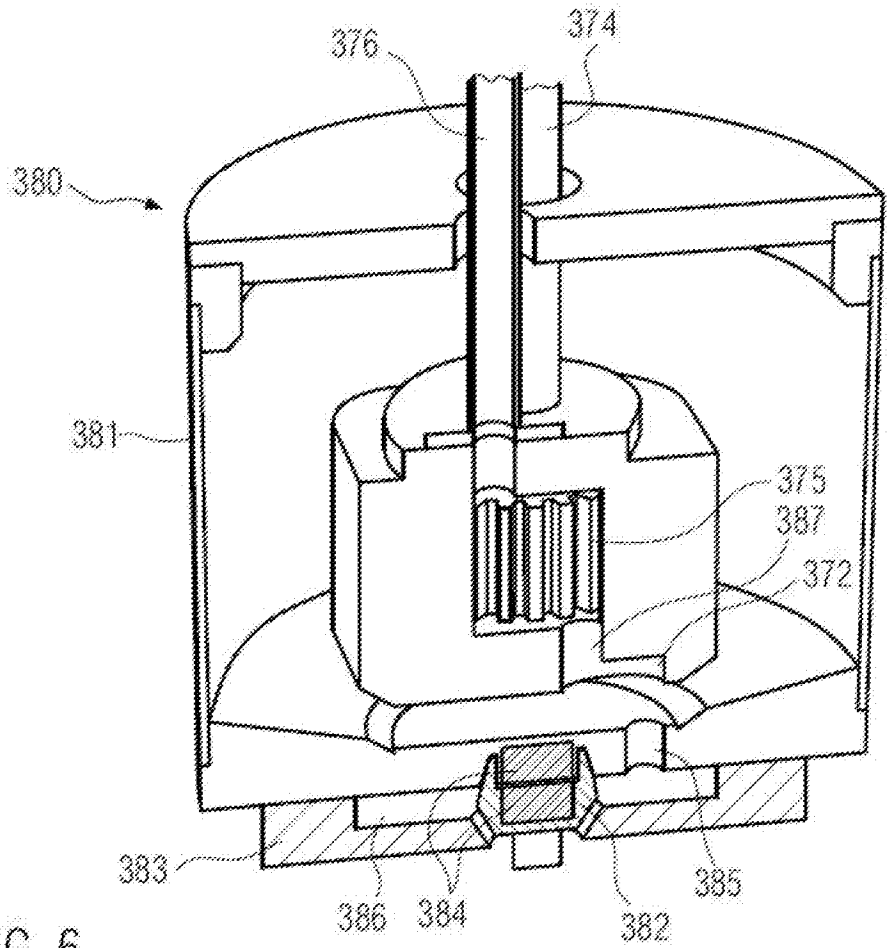
FIG. 6 shows the auxiliary tank after it has been lowered to the bottom of the storage tank.

FIG. 6 shows the auxiliary tank 380 after it has been lowered to the bottom of the storage tank (not represented). By lowering the auxiliary tank 380 onto the bottom of the storage tank, the extension at the lower end of the valve element 382 is brought into contact with the bottom of the storage tank 310. Thereby, the valve element 382 will be pushed from the closed position against the resistance of the repelling interaction of the magnets 384 to the top into an open position where glue may enter into the interior of the auxiliary tank 380 via the glue channel 386 and the bore 385. In this position, the glue pump 311 may thus already deliver glue from the storage tank indirectly via the interior of the auxiliary tank 380. Due to the extension of the valve element 382 and/or a corresponding shaping of the lower side of the bottom of the auxiliary tank, a sufficient clearance, for example of a height of at least 1 cm, between the bottom of the storage tank and the bottom of the auxiliary tank may be formed so that glue may be reliably withdrawn from the storage tank.

Figure 7:
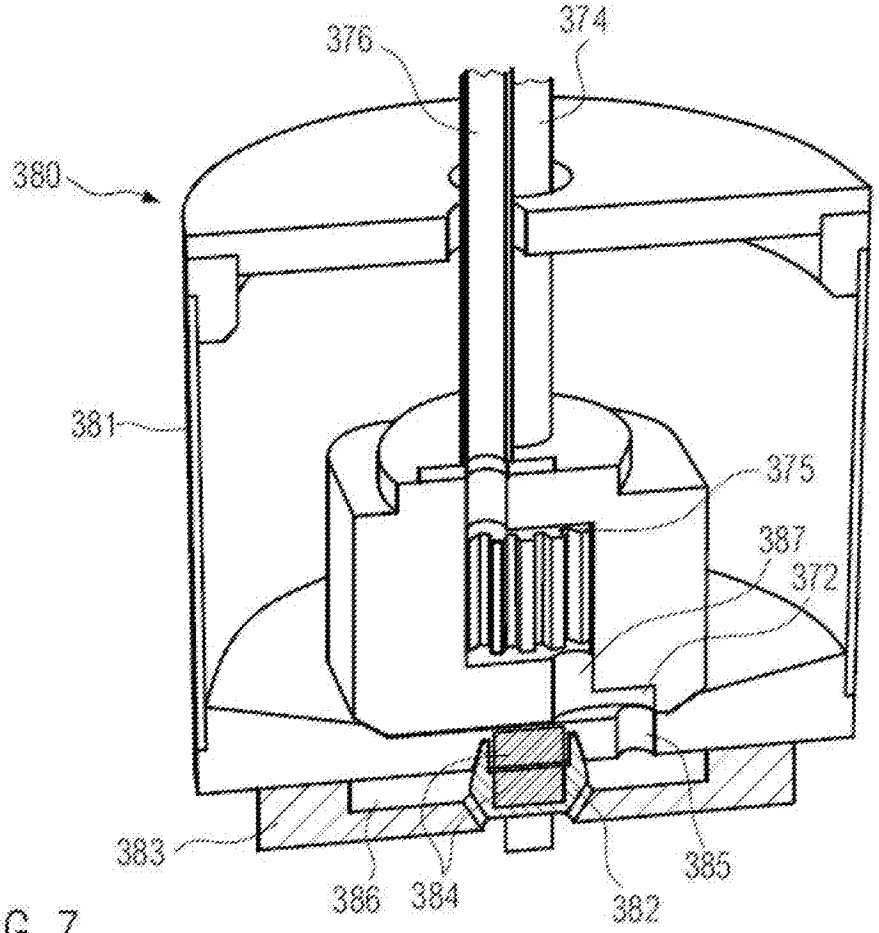
FIG. 7 shows the auxiliary tank with a completely lowered glue pump.

FIG. 7 shows the auxiliary tank 380 with the completely lowered glue pump 311 in an operating state. By further lowering the glue pump 311, the auxiliary tank 380 is not further pushed in the vertical direction as it already rests on the bottom of the storage tank 310. However, the glue pump 311 is now lowered within the auxiliary tank 380 to such an extent that the bottom region of the glue pump 311 is brought into mechanical contact with the bottom of the auxiliary tank 380. In order to be able to create a tight contact, the bottom 383 of the auxiliary tank 380 may in particular have, as is shown in FIG. 6, an indentation which corresponds, as to its shape, to the bottom region of the housing 371 of the glue pump. Moreover, the sealing ring 373 shown in FIG. 3A may be pushed against a plane surface of the bottom 383 of the auxiliary tank. In this manner, the glue inlet opening 372 of the glue pump will be sealed with respect to the interior of the auxiliary tank so that no more glue is delivered from the auxiliary tank.

In contrast, by the described lowering of the glue pump onto the bottom 383 of the auxiliary tank 380, the glue inlet opening 372 is brought into a congruent contact with the upper opening of the bore 385 so that the glue inlet opening 372, the bore 385 and the glue channel 386 form a continuous supply line 387 connecting the exterior of the auxiliary tank 380 with the delivery space of the glue pump 311. Thus, in an operating state, glue is delivered from the storage tank 310 into the rising pipe 376 via this supply line 387. As is shown in FIG. 7, the valve element 382 remains in an open position in the operating state due to the remaining contact with the bottom of the storage tank.

The auxiliary tank 380 thus efficiently provides a glue buffer from which glue may be delivered during the changing process. In this manner, an idling of the glue pump and the involved production interruption are avoided. Moreover, the pressure variations common during the start of the glue pump are eliminated.

Figure 8:
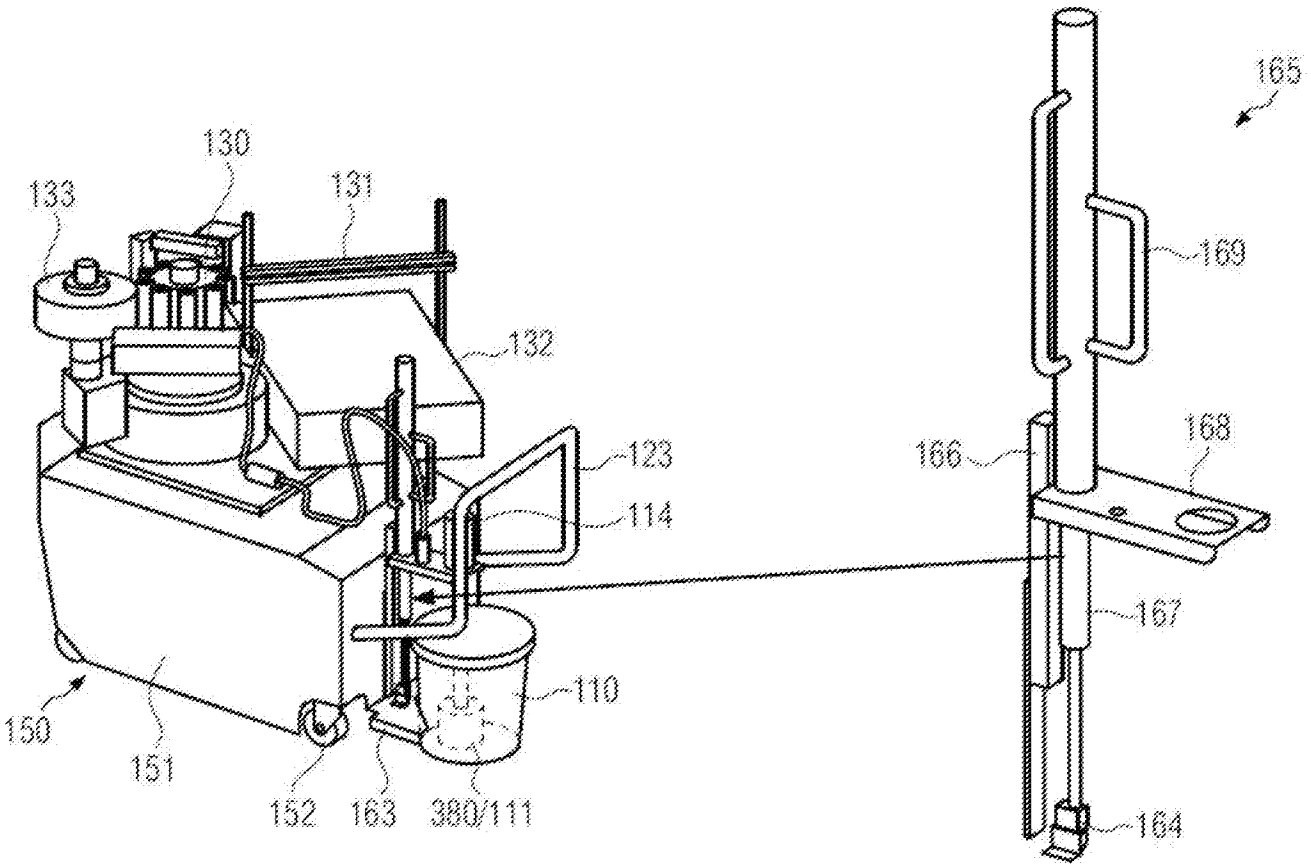
FIG. 8 shows the retention device for the glue pump connected to the labeling unit.

FIG. 8 shows the retention device 165 for the glue pump 111 connected to the labeling unit 150. In the left of the figure, the glue supply device already shown in FIG. 1 is represented together with the labeling unit 150 in a three-dimensional view. For the sake of clarity, a repeated description of the shown elements is omitted. It should only be noted as a supplement that the frame 151 of the labeling unit 150 has a coupling plate 163 against which the storage tank 110 may be placed or to which it may be coupled. Moreover, FIG. 8 shows the retention device 165 connected with the labeling unit 150 which in particular support the motor 114 and the glue pump 111. The latter is, as is schematically indicated, surrounded by the auxiliary tank 380 and already lowered to the bottom of the storage tank 110.

The retention device 165 comprise, in the shown development, a telescopic rail 166 where a cylinder provided with handles 169 is arranged to be height adjustable with a gas pressure spring 167. Due to the gas pressure spring 167, the mounting 168 that supports the motor 114 and the glue pump 111 may be shifted vertically without major expenditure of force, whereby the glue pump may be lowered into the storage tank 110 and driven out of it for changing the storage tank. The retention device 165 fixed to the labeling unit 150 thus further improve the ergonomics of the glue supply device.

Figure 9:
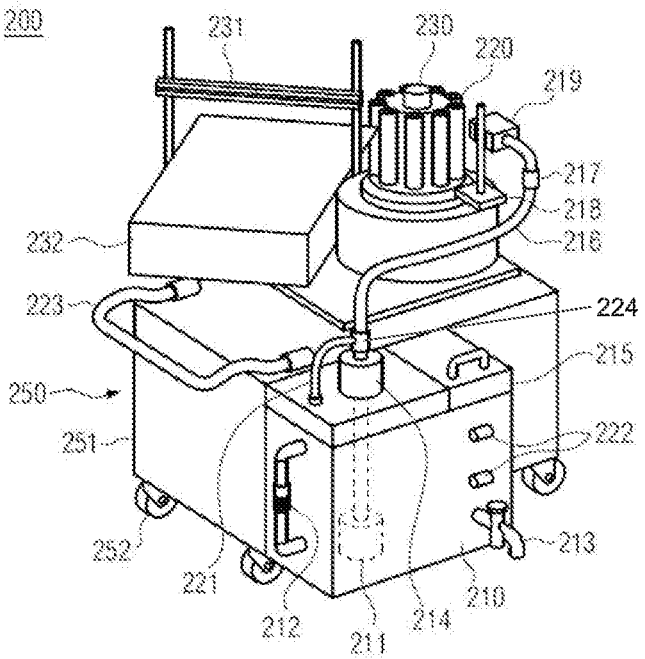
FIG. 9 schematically shows an alternative development of a glue supply device according to the present disclosure.

FIG. 9 schematically shows an alternative development of a glue supply device 200 according to the present disclosure. In this alternative development, the storage tank 210 is fixedly connected with the labeling unit 250. Thus, the glue supply device 200 forms, together with the labeling unit 250, a module which may in particular be mounted, as is shown, in a mobile manner on rollers 252. Here, too, the labeling unit 250 has a frame 251 at which further components, such as a guide handle 223, may be arranged. In FIG. 9, moreover the pallet carousel 230 with a plurality of pallets 220 and a label unit 232 with a label container 231 for storing the labels to be glued are explicitly shown. These components are well-known in prior art and are therefore not further described herein. The components may moreover also be provided in the development described in connection with FIG. 1.

At the pallet carousel 230 or at the frame 251, respectively, a mounting 218 is arranged which holds the glue printer 219, in particular in a height adjustable manner. The glue printer is connected with the motor 214 of a glue pump 211, which has been lowered onto the bottom of the storage tank 210, as shown in the figure, via an elastic supply line 216. Here, too, the arrangement is selected such that a sufficient clearance for sucking in glue is available. Since the storage tank 210 is in this development fixedly connected to the labeling unit 250, the height adjustable retention device may be omitted. Instead, the upper region of the storage tank 210 includes a lid 215 which may be opened for refilling the storage tank. Since this refilling may also be done during operation, the above-described auxiliary tank may also be omitted. The glue pump may thus be embodied in the form of a gear pump which is driven in a controllable manner by the motor 214. The same developments that have been described in connection with the previous figures for the glue pump, the supply line, the open-loop and/or closed-loop control unit (not represented), the sensors, i.e. the flow meter device, the pressure sensor and the temperature sensor, and the like are also applicable to the development shown in FIG. 9. The storage tank 210 includes, for example, a level indicator in the form of a filling level pipe 212 or filling level sensors 222. Moreover, the supply line may comprise the above described heating device. Such a supply line, however, may also be arranged within or at the storage tank 210. At the supply line 216, the already described hydropneumatic reservoir 217 is arranged.

In addition, FIG. 9 shows a safety valve 224 with a return line 221 via which glue from the supply line 216 may be returned into the storage tank 210 if a limiting value for the glue pressure is exceeded. The safety valve 224 may be arranged at the supply line 216. The safety valve is here designed such that it automatically opens when the limit pressure is exceeded. Such a safety valve with a return line may also be inserted in the development described in connection with FIG. 1.

Finally, the storage tank 210 has a drain cock 213 in the lower region of the container wall for manually draining the glue from the storage tank if this is necessary, for example for cleaning the storage tank.

The shown development with a storage tank permanently fixed to the labeling unit may be particularly advantageously used for glues having a low viscosity, for example within a range of 10 to 100 mPas, as these may be easily refilled into the storage tank by canisters. Due to the small pack size, only small loads must be moved which contributes to the ergonomics of the use of the plant.

Figure 10:
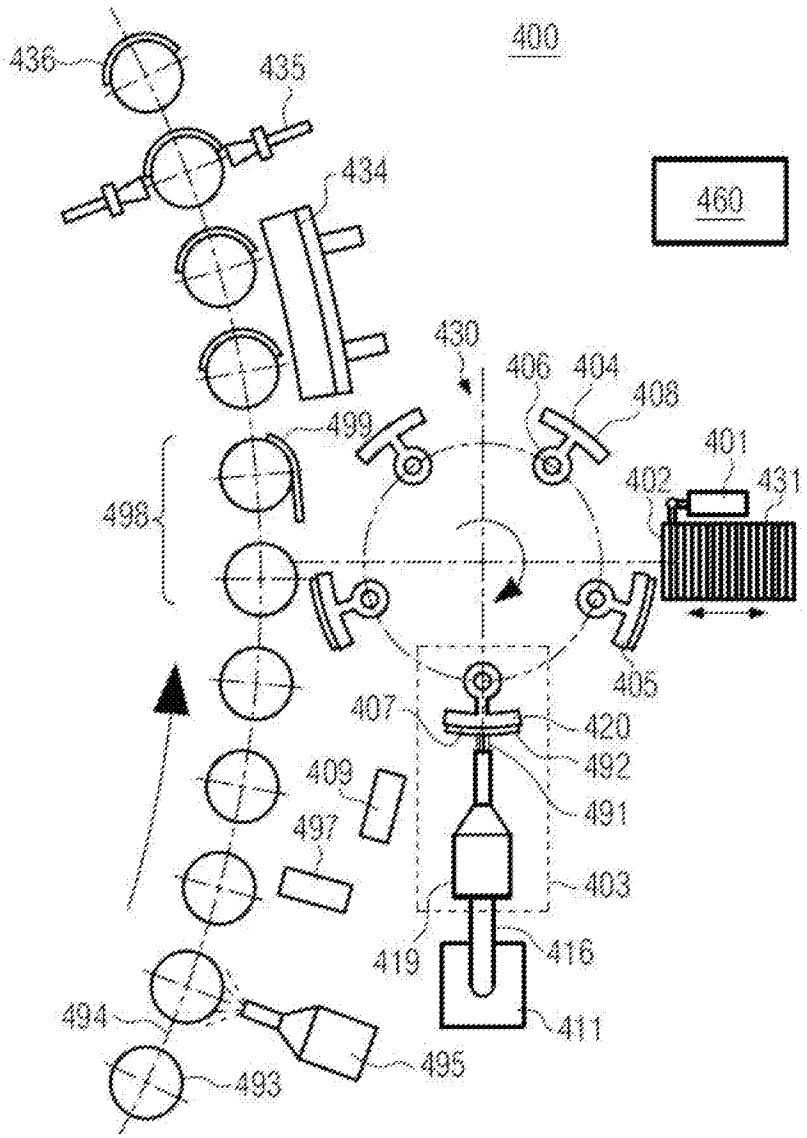
FIG. 10 schematically shows a plan view of a labeling device of prior art.

FIG. 10 schematically shows a plan view of a labeling device of prior art which may be employed in connection with the above described labeling units and glue supply devices.

The shown labeling device 400 here comprises a transport device embodied as a container table 494 along which the containers 493 or packs to be labeled circulate on a plurality of mountings (not represented) rotatable around themselves on a curved path. A further element of a labeling device that is often used is, for example, a pretreatment unit 495 which prepares the container 493 to be labeled for labeling by cleaning or pre-moistening the container surface to be labeled, or by subjecting the same to blowing or a heating and/or radiation and/or plasma and/or corona treatment. Furthermore, sensors 409 and 497 may be provided which measure the condition of the surface to be labeled, e. g. smooth, rough etc., and/or ambient conditions, such as an ambient temperature or humidity, and transmit it to the open-loop and/or closed-loop control unit 460 for controlling the labeling device. Furthermore, a roll-on unit 434 and/or a brush-on unit 435 may be provided downstream of the labeling position 498 to completely apply and press on the label 499 placed onto the container. The containers provided with the label 436 are subsequently transferred to a following treatment station, for example a filling station for filling them with liquid food.

The labeling unit represented in the exemplary labeling machine comprises a pallet carousel 430 with a plurality of pallets 404, 405, and 420 circulating about an axis of rotation of the pallet carousel and which are themselves each embodied to be pivoting about their own, eccentrically mounted swiveling axes 406. The pallets have, on their side facing outwards, a locating surface 408 which may be large enough to be able to accommodate a plurality of different label sizes. The initially unloaded pallet 404 is, during its circulation about the axis of rotation of the pallet carousel 430, guided past a label reservoir 431 in the form of a label box disposed at the periphery of the pallet carousel and pivoted such that the locating surface 408 of the pallet picks up the foremost label 402 from the label box 431 presented with its image side. Since the pallets may be embodied as vacuum pallets, this pick-up is also reliably possible without previously applying glue onto the locating surface 408. To be able to adapt the distance of the foremost label 402 to the pallet carousel 430, the label box 431 may be designed to be switchable via a pneumatic cylinder 401.

Since the labels 402 are provided with their image sides to the front, they also come to lie with their image sides on the locating surface 408 of the pallet 405. Thus, the glue application surface 492 of the labels 407 transported by the pallets 405 and 420 faces away from the locating surface of the respective pallet. The glue application surface of the label 407 thus facing outwards may therefore be glued directly on the pallet by means of a gluing unit 403 disposed at the orbit of the pallets 404, 405 and 420, i.e. at the periphery of the pallet carousel 430. In FIG. 10, a gluing unit 403 according to the ink-jet method is shown according to the present disclosure.

If a glue printer 419 is used, the cold glue is injected directly onto the glue application surface 492 from a plurality of glue nozzles in the form of a glue jet 491. To this end, the glue application surface 492 is guided, optionally at a constant distance, past the openings of the glue nozzles by circulating and pivoting the pallet. By purposefully controlling the glue nozzles, for example according to the DoD principle (drop-on-demand), in superimposition with the pallet movement, an approximately arbitrary glue pattern may be printed onto the glue application surface 492. In particular, exactly the required amount of cold glue may be printed on, so that a glue return may completely be omitted.

The supply of glue to the glue printer 419 via the glue supply conduit 416 may be done in a controlled manner in the required amount by means of one of the above-described glue supply devices. This is indicated in FIG. 10 for the gluing unit 403. FIG. 10 representatively only shows, for the above described glue supply devices, the glue supply conduit 416 and a schematic representation of the glue pump 411.

Since the cold glue is applied onto the glue application surface 492 facing outwards, in this not limiting development no gripper cylinder is required for placing the now glued labels 407 onto the containers 493 to be labeled. Instead, the labels are directly placed onto the containers 493 guided past the labeling position 498 by the pallets 404, 405 and 420 and are wound upon the containers by a rotary motion of the mountings of the container table 494. To this end, the pallets are guided past the container surfaces and pivoted such that the labels taken along in combination with the rotary motion of the containers and their circulation about the container table are rolled onto the container surfaces. As was already mentioned, by mounting the bent pallets 404, 405 and 420 in a suited eccentric manner at their respective swiveling axes 406, a slip-free rolling-off of the labels onto the container surfaces may be achieved, so that the applied labels do not unintentionally get out of place.

The orbital movements of the pallets 404, 405 and 420 and the mountings of the container table 494 may be controlled by means of controllable drives (not represented) via the open-loop and/or closed-loop control unit 460 of the labeling device 400. Equally, the rotary motion of the mountings for the containers may be controlled by means of the open-loop and/or closed-loop control unit, for example via individually provided servomotors. The pivoting movements of the pallets 404, 405 and 420 may be controlled via corresponding radial cams or also via servomotors provided just for this purpose by means of the open-loop and/or closed-loop control unit. Finally, the vacuum supply and the glue nozzles may be controlled, as described above, via the open-loop and/or closed-loop control unit 460. The open-loop and/or closed-loop control unit may in particular be a stored program control unit which includes a storage unit, for example in the form of a flash memory, in which the storage parameters required for the control, e. g. with respect to the desired glue pattern, are stored. In particular, a common open-loop and/or closed-loop control unit 460 for the labeling device 400 and the glue supply device may be provided.

It will be appreciated that the above-described glue supply devices may also be applied to differently embodied labeling devices. For example, the positions of the labeling box 431 and the gluing station 403 may be exchanged so that initially, a defined glue pattern is applied to a glue application surface 408 of the pallets 404 which is then brought into contact with a back of the labels 402. The image side of the labels is subsequently transferred to a gripper cylinder as it is generally known in prior art. By means of the gripper cylinder, the labels are finally applied onto the containers 493.

The above-described glue supply devices permit the application of a well-defined glue pattern with a nearly constant glue pressure without the otherwise usual production interruptions for changing the storage tank for the glue. The closed glue supply system moreover improves the durability of the cold glue. Since the applied amount of cold glue may now be exactly adjusted, a return of excessive cold glue may also be omitted. If a low-viscosity cold glue is used, the energy consumption of the labeling unit may moreover be reduced.

The invention claimed is:

1. A glue supply device for a labeling unit with a glue printer, comprising:

a storage tank for glue having a low viscosity;

a supply line for supplying glue from the storage tank to the glue printer;

a continuously delivering glue pump which is embodied to deliver glue from the storage tank into the supply line; and a hydropneumatic reservoir for the glue, wherein the hydropneumatic reservoir is arranged at the supply line upstream of the glue printer.

2. The glue supply device according to claim 1, wherein the glue pump is embodied as a gear pump.

3. The glue supply device according to claim 2, wherein the gear pump is an external gear pump.

4. The glue supply device according to claim 1, wherein the glue pump is embodied to be controllable by closed-loop control, and further comprising a pressure gauge device and a closed-loop control unit, wherein the pressure gauge device is arranged directly upstream of or at the glue printer and is embodied to determine a glue pressure upstream of the glue printer, and wherein the closed-loop control unit is embodied to control the glue pump as a function of the determined glue pressure.

5. The glue supply device according to claim 1, further comprising a retention device which is embodied to fix the glue pump to the labeling unit in a height adjustable manner.

6. The glue supply device according to claim 5, wherein the retention device comprises a telescopic rail and a cylinder with a gas pressure spring for a height adjustment of the glue pump.

7. The glue supply device according to claim 1, further comprising an auxiliary tank, wherein the auxiliary tank is connected with the glue pump such that, when the storage tank is being exchanged, glue is withdrawn from the auxiliary tank by means of the glue pump.

8. The glue supply device according to claim 7, wherein the auxiliary tank surrounds the glue pump and comprises a valve element which is designed to open the auxiliary tank when in contact with a bottom of the storage tank and to otherwise close it.

9. The glue supply device according to claim 8, wherein the glue pump is embodied to be movable relative to a bottom of the auxiliary tank.

10. The glue supply device according to claim 9, wherein the bottom of the auxiliary tank has a bore, wherein the bore forms, by lowering the glue pump, a supply line for glue from the storage tank together with a corresponding glue inlet opening of the glue pump, which supply line is closable by the valve element.

11. The glue supply device according to claim 1, wherein the storage tank is embodied to be exchangeable, and further comprising a mechanical receiving device for coupling the storage tank to the labeling unit.

12. The glue supply device according to claim 11, wherein the glue pump is driven out of the storage tank by means of a retention device for exchanging the storage tank, and wherein a filled storage tank is driven towards the glue supply device by means of a pack carriage.

13. The glue supply device according to claim 11, wherein the storage tank is a mobile module, and wherein the mechanical receiving device is a coupling plate.

14. The glue supply device according to claim 1, wherein the storage tank is fixedly connected to the labeling unit and includes a lid which is openable at least partially.

15. The glue supply device according to claim 14, wherein the glue has a viscosity within a range of 3 to 300 mPas, and wherein the storage tank is refilled by means of canisters through the opened lid.

16. The glue supply device according to claim 15, wherein the glue has a viscosity within a range of 10 to 100 mPas.

17. The glue supply device according to claim 1, wherein a safety valve is arranged at the supply line which is embodied to open an outlet when a limit pressure in the supply line is exceeded.

18. The glue supply device according to claim 1, wherein the glue is a cold glue.

19. A labeling unit for applying labels onto containers, comprising:

a pallet carousel with a plurality of pallets to be driven to circulate about an axis of rotation;

a glue printer disposed in a periphery of the pallet carousel having a plurality of glue nozzles controllable individually or in groups; and a glue supply device for continuously supplying the glue printer with glue, wherein the glue supply device comprises:

a storage tank for glue having a low viscosity, a supply line for supplying glue from the storage tank to the glue printer, a continuously delivering glue pump which is embodied to deliver glue from the storage tank into the supply line, and a hydropneumatic reservoir for the glue, wherein the hydropneumatic reservoir is arranged at the supply line upstream of the glue printer.

20. The labeling unit according to claim 19, wherein the glue is a cold glue.

* * * * *